US007823354B2

(12) United States Patent
Wheatley

(10) Patent No.: US 7,823,354 B2
(45) Date of Patent: Nov. 2, 2010

(54) STRUCTURE REINFORCEMENT SYSTEM

(76) Inventor: Donald E. Wheatley, 1119 Wright St., Ann Arbor, MI (US) 48105

( * ) Notice: Subject to any disclaimer, the term of this patent is extended or adjusted under 35 U.S.C. 154(b) by 113 days.

(21) Appl. No.: 11/272,503

(22) Filed: Nov. 11, 2005

(65) Prior Publication Data

US 2006/0059827 A1 Mar. 23, 2006

Related U.S. Application Data

(63) Continuation-in-part of application No. 10/832,019, filed on Apr. 26, 2004, now Pat. No. 7,743,585.

(51) Int. Cl.
*E04B 2/00* (2006.01)

(52) U.S. Cl. ..... 52/506.01; 52/506.05; 52/364; 52/367

(58) Field of Classification Search ..... 52/506.05, 52/506.01, 364, 367, 443, 514, 597, 745.05, 52/746.1, 741.3, 741.4, 745.09, 741.1, 293.2, 52/309.1, 309.2, 736.3, 309.17; 24/48.2, 24/220.21

See application file for complete search history.

(56) References Cited

U.S. PATENT DOCUMENTS

| | | | | |
|---|---|---|---|---|
| 2,898,258 | A * | 8/1959 | Meier et al. | 52/309.2 |
| 3,239,403 | A | 3/1966 | Williams | |
| 4,916,874 | A | 4/1990 | McCoy et al. | |
| 5,635,263 | A | 6/1997 | Saito | |
| 5,640,825 | A | 6/1997 | Ehsani et al. | |
| 5,649,398 | A | 7/1997 | Isley, Jr. et al. | |
| 5,845,450 | A | 12/1998 | Larsen | |
| 5,894,003 | A | 4/1999 | Lockwood | |
| 6,145,260 | A | 11/2000 | Morton | |
| 6,263,629 | B1 | 7/2001 | Brown, Jr. | |
| 6,418,684 | B1 | 7/2002 | Morton | |
| 6,692,595 | B2 | 2/2004 | Wheatley et al. | |
| 6,746,741 | B2 | 6/2004 | Wheatley | |
| 7,048,880 | B2 * | 5/2006 | Kia et al. | 264/101 |

FOREIGN PATENT DOCUMENTS

JP 2000-265141 9/2000

OTHER PUBLICATIONS

ACI Structural Journal, Technical Paper, Title No. 91-S17, Mar.-Apr. 1994, "Strengthening of Initially Loaded Reinforced Concrete Beams Using FRP Plates," by Alfarabi Shari, G.J. Al-Sulaimani, I.A. Basunbuil, M.H. Baluch, and B.N. Ghaleb.

ACI Structural Journal, Technical Paper, Title No. 91-S34, May-Jun. 1994, "Fiber Composites for New and Existing Structure," by Hamid Saadatmanesh.

* cited by examiner

*Primary Examiner*—Richard E Chilcot, Jr.
*Assistant Examiner*—Mark R Wendell
(74) *Attorney, Agent, or Firm*—Harness, Dickey & Pierce, P.L.C.

(57) ABSTRACT

A concrete reinforcing system includes a reinforcing member that is adapted to be adhered to a structure through the use of an adhesive. The reinforcing member includes a first leg and a second leg. The first leg is adapted to penetratingly engage the structure or a surface of the structure. The second leg is adapted to adhere to another surface of the structure. The second leg angularly extends from the first leg.

13 Claims, 11 Drawing Sheets

STRUCTURE REINFORCEMENT SYSTEM

CROSS-REFERENCE TO RELATED APPLICATIONS

This application is a continuation-in-part of U.S. patent application Ser. No. 10/832,019 filed on Apr. 26, 2004. The disclosure of the above application is incorporated herein by reference.

FIELD OF THE INVENTION

The present invention relates to a device for reinforcing structures and a method of manufacturing and attaching the product to a structure and, in particular, to a device for reinforcing concrete structures including at least one rigidified retaining member.

BACKGROUND OF THE INVENTION

Walls constructed of concrete blocks are well known in the field of construction and have been extensively used for walls both above and below ground. Walls constructed in this manner are generally capable of supporting residential and light commercial structures and are relatively inexpensive to manufacture. In order to construct a concrete wall, individual blocks are laid end-to-end and successive rows or courses are stacked thereon. Mortar between each adjacent block and row secures the wall together. These walls are such that they have excellent compressive strength to support structures placed upon them. However, these walls are inherently weak with respect to lateral loads and are particularly susceptible to cracking from water pressure. This inherent weakness is attributable to the structural characteristics of the walls themselves and the mortar joints at which they are connected. Specifically, the mortar joints are weak in tension and when subject to tensile forces, tend to separate relatively easily.

Water penetrating deeply into the soil adjacent a basement wall can cause substantial lateral movement of the soil and pressure against the wall. Over a period of time, block walls may be seen to develop diagonal cracks at their ends and vertical cracks near their centers. Such cracks can admit water from the surrounding soil and if left untreated, can progressively widen and eventually facilitate collapse of the entire wall with resultant damage to the structure supported on it. In addition to developing cracks, block walls typically either tilt or bow inwardly and such bowing or tilting steadily worsens under the weight of the overlying structure.

These problems are not only limited to walls constructed of concrete blocks. These problems are also inherent in solid concrete structures. Such concrete structures include, but are not limited to, solid concrete walls, pillars, columns, and support beams, such as those used in bridges or overpasses.

One of the traditional methods of repairing the cracks and relieving the external pressure is to drill holes and provide for channeling of the water away on the inside. Yet another method is to fill the cracks by injection of an epoxy resin. Although these methods help to control further water from entering the cracks, they do not prevent the walls from further cracking or bowing.

Yet another means of fixing cracks in concrete structures is to bond carbon fibers thereto, as disclosed in commonly owned U.S. Pat. No. 6,692,595. Carbon fibers are typically provided in a mesh-type structure such that an epoxy used to bond the fibers to the wall wholly encompass the fibers. Although carbon provides great tensile strength, it appears that in some installations it is strong enough to actually pull the concrete loose from the wall.

SUMMARY OF THE INVENTION

An assembly for reinforcing a structure is provided. The assembly generally includes a rigid sheet and a bracket. The rigid sheet is adapted to be adhered to the structure. The bracket includes a first leg and a second leg. The first leg is adapted to penetratingly engage the structure. The second leg adheres to the rigid sheet. The first and second legs extend substantially perpendicular to each other.

Another aspect of the present invention provides a method of reinforcing a structure. First, material is removed from the structure to form an elongated recess. A first article is adhered to the structure generally adjacent to the recess. A first leg of a second article is adhered in the recess such that a second leg of the second article adheres to the first article.

Another aspect of the present invention provides for a reinforcing system. The system includes a reinforcing member that is adapted to be adhered to a structure through the use of an adhesive. The reinforcing member includes a first leg and a second leg. The first leg is adapted to penetratingly engage the structure. The second leg is adapted to adhere to a surface of the structure. The second leg angularly extends from the first leg.

Another aspect of the present invention provides for a method of reinforcing a structure. First, material is removed from the structure to form an elongated recess. A first leg of a first article is adhered to the structure in the recess. A second leg of the first article is adhered to a surface of the structure.

Another aspect of the present invention provides for a reinforcing system. The system includes a reinforcing member that is adapted to be adhered to a structure through the use of an adhesive. The reinforcing member includes a first leg and a second leg. The first leg is adapted to adhere to a first surface of the structure. The second leg is adapted to adhere to a second surface of the structure. The second leg angularly extends from the first leg.

Another aspect of the present invention provides for a method of reinforcing a structure. First, either a reinforcing member or a structure is substantially saturated with an adhesive. A first leg of the reinforcing member is adhered to a first surface of the structure. A second leg of the reinforcing member is adhered to a second surface of the structure.

Another aspect of the present invention provides for a reinforcing member for reinforcing a structure. The member is a rigidified mesh material that includes a first leg and second leg. The second leg angularly extends from the first leg.

Another aspect of the present invention provides for a method of forming a reinforcing member. First, a mesh material is substantially saturated with an adhesive. Second, the mesh material is formed into a reinforcing member. Third, the reinforcing member is hardened to rigidify the reinforcing member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the scope of the invention, its application, or its uses.

Figure 1:
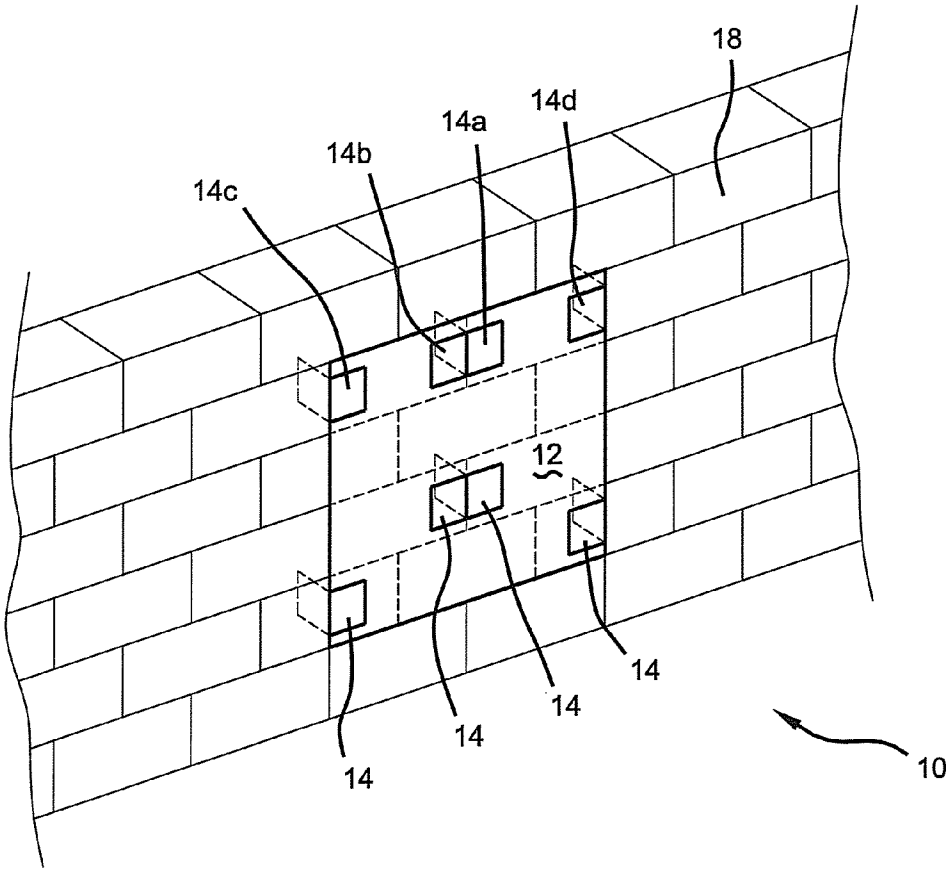
FIG. 1 is a perspective view of a first embodiment of a reinforcing assembly in accordance with the principles of the present invention.
Figure 2:
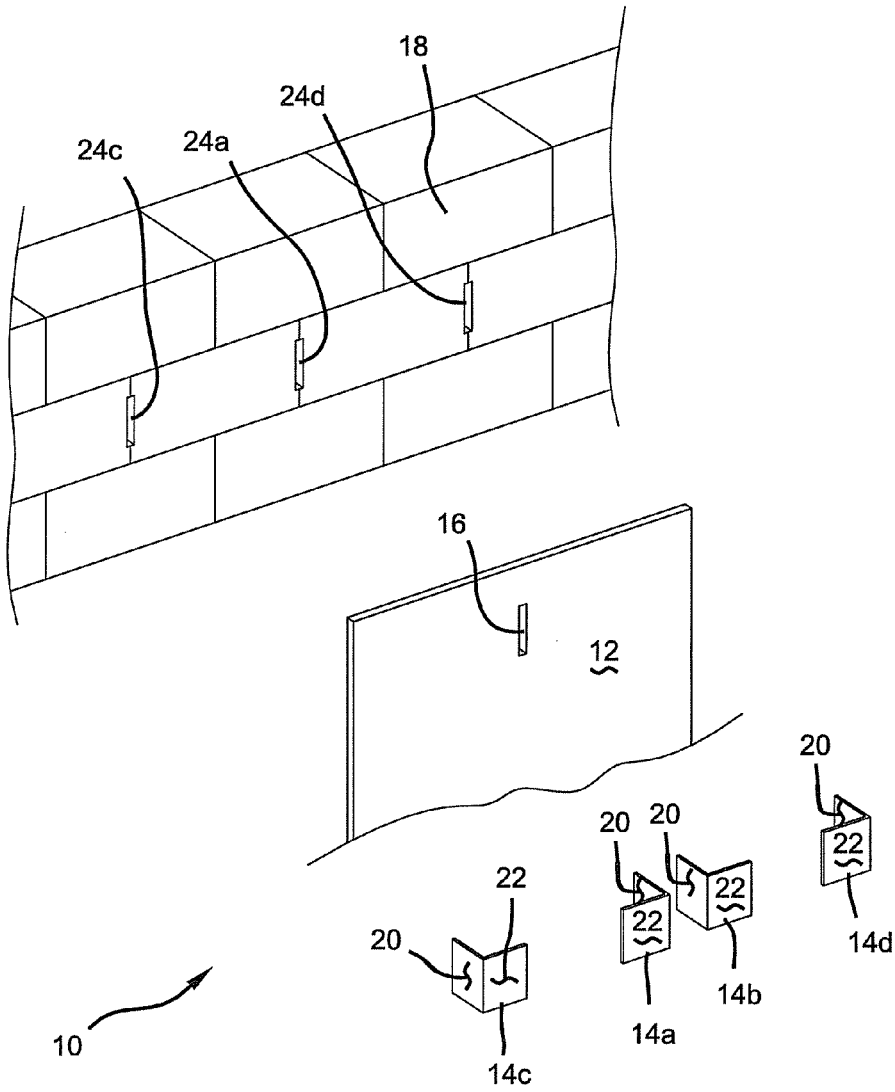
FIG. 2 is a partial exploded view of the reinforcing assembly of FIG. 1.

FIGS. 1 and 2 illustrate a first exemplary embodiment of a reinforcing assembly 10 in accordance with the present invention. The reinforcing assembly 10 generally includes a rigid sheet 12 and a plurality of brackets 14. The rigid sheet 12 is adapted to be adhered to a structure 18 and the brackets 14 are adapted to mechanically reinforce this adhesion. In one embodiment, the rigid sheet 12 and brackets 14 are metal plates or fiber reinforced plates. In another embodiment, the rigid sheet 12 and brackets 14 are rigidified mesh-structures, as will be described in more detail below. It should also be understood that the sheet 12 and brackets 14 can also be formed as non-rigid members although they are described in the preferred embodiments as being generally rigid.

The rigid sheet 12 is generally planar and includes at least one vertical slot 16 (shown in FIG. 2). In FIG. 1, the rigid sheet 12 is adhered to a structure 18 such as a masonry wall. In an exemplary embodiment, the rigid sheet 12 is adhered to the wall 18 with an epoxy resin. Each bracket 14 is generally L-shaped and includes a first leg 20 and a second leg 22. The first legs 20 are adapted to engage one of a plurality of recesses 24 (shown in FIG. 2) formed in the wall 18. The second legs 22 are adapted to engage the rigid sheet 12.

The brackets 14 can engage the rigid sheet 12 in a variety of alternative configurations. For example, brackets 14*a* and 14*b* illustrate a first configuration. The first legs 20 of brackets 14*a* and 14*b* are received through a common slot 16 formed in the rigid sheet 12. The first legs 20 then engage recess 24*a* formed in the wall 18. The recess 24*a* is preferably filled with an adhesive to securely anchor the first legs 20 in the recess 24*a*. Then, the second legs 22 engage the rigid sheet 12. In an exemplary embodiment, the second legs 22 are adhered to the rigid sheet 12 using an adhesive similar to that which adheres the rigid sheet 12 to the wall 18. It should be appreciated that in another configuration, only one bracket 14 is received through slot 16 to engage recess 24*a*.

Brackets 14*c* and 14*d* illustrate a second configuration. The first legs 20 of brackets 14*c* and 14*d* engage recesses 24*c* and 24*d* formed in the wall 18 without being received through a slot in the rigid sheet 12. The second legs 22 of brackets 14*c* and 14*d* then engage an edge region of the rigid sheet 12 and are adhered thereto. In each of the above-described configurations, the brackets 14 are adhesively anchored to the wall and mechanically reinforce the adhesive engagement between the rigid sheet 12 and the wall 18. Furthermore, it should be appreciated that each of the brackets 14 are substantially identical regardless of the configuration utilized.

Figure 3:
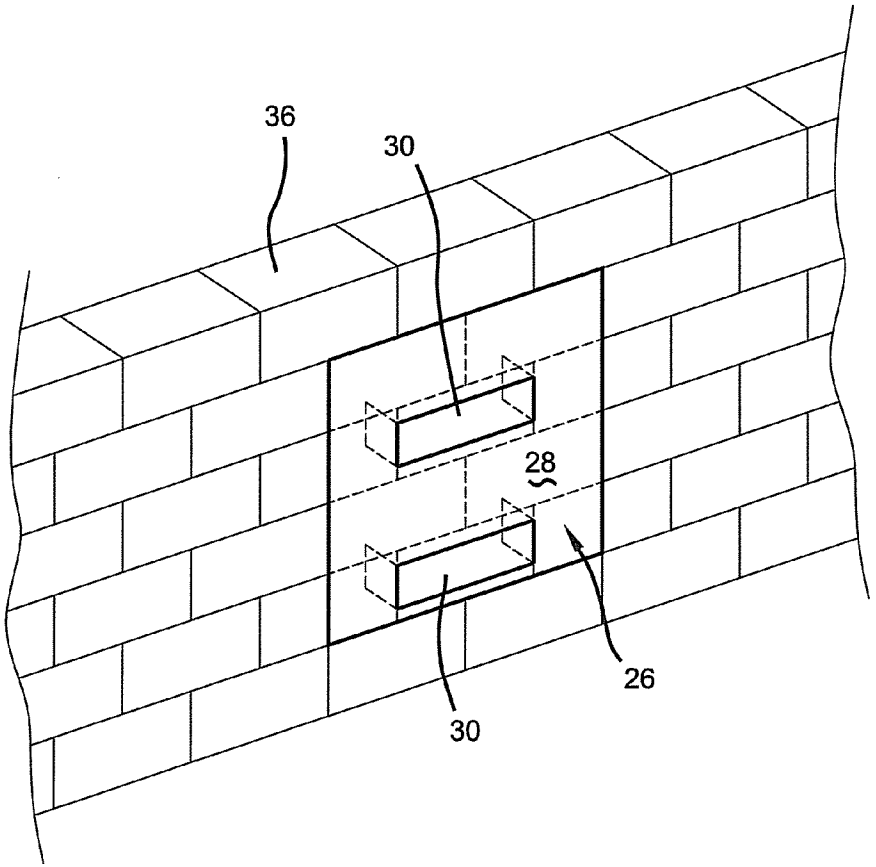
FIG. 3 is a perspective view of a second embodiment of a reinforcing assembly in accordance with the present invention.
Figure 4:
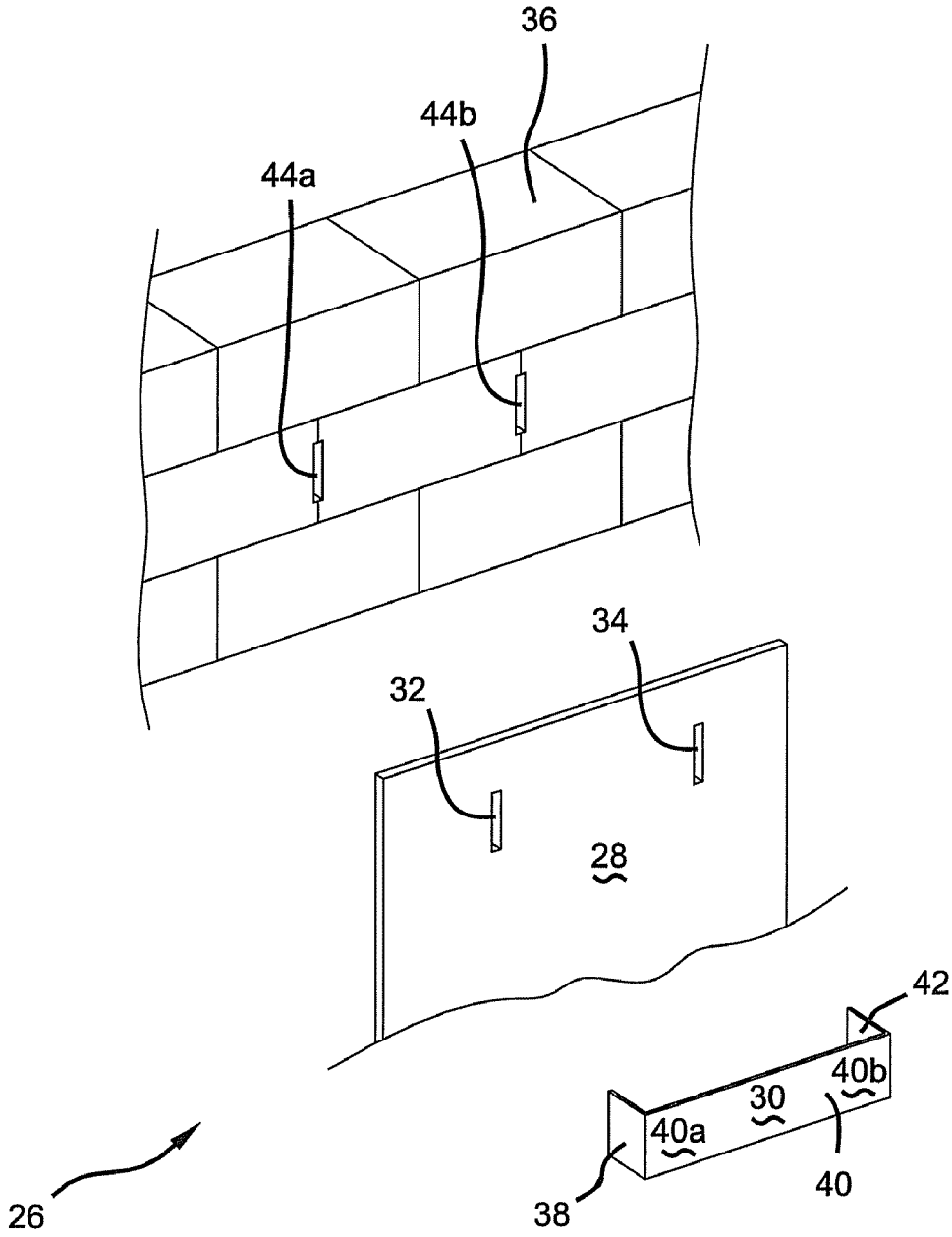
FIG. 4 is a partial exploded view of the reinforcing assembly of FIG. 3.

FIGS. 3 and 4 illustrate an alternative embodiment of a reinforcing assembly 26 in accordance with the present invention. The reinforcing assembly 26 generally includes a rigid sheet 28 and a plurality of brackets 30. The rigid sheet 28 is substantially similar to that of the first embodiment with the exception that it includes first and second substantially parallel vertical slots 32, 34. The rigid sheet 28 is adhered to a structure 36, such as a masonry wall. Similar to that described above, the rigid sheet 28 is adhered to the wall 36 with an epoxy resin or can be fastened by other known methods. Each bracket 30 includes a first leg 38, a bridge portion 40, and a second leg 42. The first leg 38 extends generally perpendicular from a first end 40*a* of the bridge portion 40. The first leg 38 is received through the first slot 32 formed in the rigid sheet 28 and adhesively engages a first recess 44*a* formed in the wall 36. The second leg 42 extends generally perpendicular from a second end 40*b* of the bridge portion 40. The second leg 42 is received through the second slot 34 in the rigid sheet 28 and adhesively engages a second recess 44*b* formed in the wall 36. The bridge portion 40 engages a region of the rigid sheet 28 located between the first and second slots 32, 34 and is adhered thereto. In this manner, the bracket 30 mechanically reinforces the adhesive engagement between the rigid sheet 28 and the wall 36.

Figure 5:
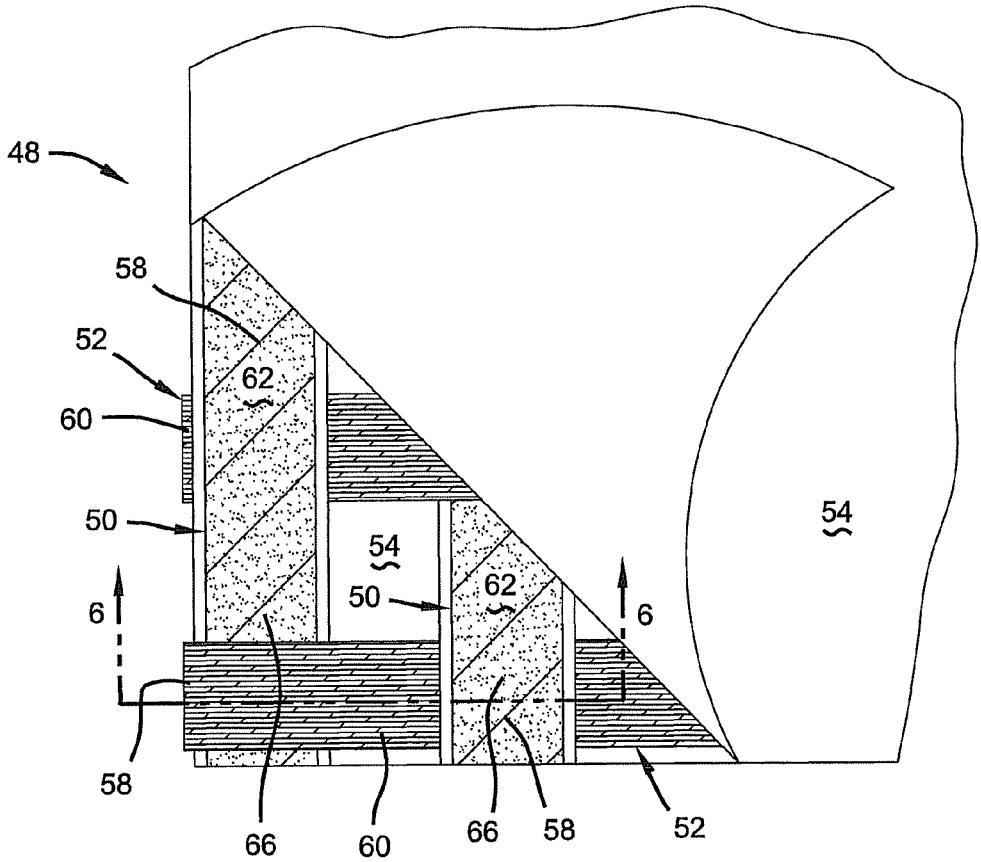
FIG. 5 is a partial detail view of a mesh structure in accordance with the present invention.
Figure 6:
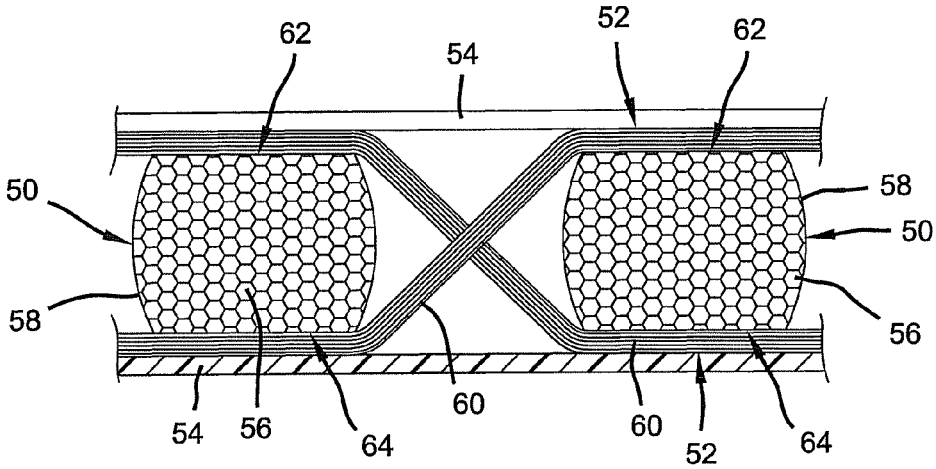
FIG. 6 is a cross-section through line VI-VI of FIG. 5.

Referring now to FIGS. 5 and 6, a mesh structure 48 as mentioned above as an alternative to a metal or fiber reinforced plate will now be described. The mesh structure 48 generally includes a plurality of longitudinally extending members 50 (preferably including carbon or similar material), a plurality of laterally extending members 52 (preferably including flexible fibers), and a removable film 54. The longitudinally extending members 50 are substantially parallel to one another and uniformly spaced apart a distance between 1/32" and 1". The laterally extending members 52 are also substantially parallel to each other and uniformly spaced apart a distance between 1/32" and 1". Furthermore, the laterally extending members 52 are interwoven between the longitudinally extending members 50, thereby defining the mesh structure 48. The mesh structure 48 further includes an adhesive coating (not shown). The adhesive coating increases the structural integrity of the mesh structure 48. In one embodiment, the adhesive coating is an epoxy resin. In another embodiment, the adhesive coating is a thermoset adhesive. The adhesive coating gives the mesh structure rigidity.

The removable film 54 includes an impermeable material such as nylon, plastic, or a textile and is preferably textured on at least one surface. The textured surface of the removable film 54 is adhered to the mesh structure 48 via the adhesive coating. The removable film 54 is adapted to be removed prior to adhering the rigid sheet 12, 28 and brackets 14, 30 to a wall 18, 36. In an exemplary embodiment, a piece of removable film 54 is attached to each side of the mesh structure 48. One purpose of the removable film 54 is to keep the surfaces of the mesh structure 48 clean and free from dust and debris, thereby increasing its bonding potential. The textured film 54 also provides a roughened surface to enhance the adhesive properties of the rigid sheet 12.

The longitudinally extending members 50 each include a plurality of fibers 56 bound together by a wrapping 58. In an exemplary embodiment, the fibers 56 are carbon fibers and the wrapping 58 includes a single strip of nylon coiled around the plurality of carbon fibers. In an alternative exemplary embodiment, the fibers 56 include a plurality of metal wires. In yet another alternative embodiment, the longitudinally extending members 50 are solid metal wires. The laterally extending members 52 each include a plurality of flexible fibers 60 such as nylon or Kevlar®.

The longitudinally extending members 50 are generally circular in cross-section having a first flattened surface 62 and a second flattened surface 64. The flattened surfaces 62 and 64 each include a plurality of indentations 66 formed in the adhesive coating. The plurality of indentations 66 are a product of the textured film 54. The plurality of indentations 66 increase the surface area of the mesh structure 48, thereby enhancing its engagement potential with an adhesive when adhered to a wall 18, 36.

A method of constructing the above-described mesh structure 48 in accordance with a reinforcing assembly 10, 26 of the present invention is now described. First, a plurality of rigid fibers 56 are bundled together and wrapped with wrapping 58. This is repeated until a multiplicity of longitudinally extending members 50 are prepared. Next, a plurality of flexible fibers 60 are gathered to form a laterally extending member 52. This is also repeated until a multiplicity of laterally extending members 52 are prepared. The multiplicity of laterally extending members 52 are then alternately interwoven above and below the longitudinally extending members 50. This creates the basic geometry of the mesh structure 48 shown in FIG. 5.

Next, the entire mesh structure 48 is wetted with a liquid adhesive to provide the adhesive coating described above. In an exemplary embodiment, the mesh structure 48 is submerged in an adhesive bath. In another embodiment, the mesh structure 48 is exposed to an adhesive mist. In yet another embodiment, a liquid adhesive is brushed or rolled onto the mesh structure 48.

Subsequent to applying the adhesive, but prior to it curing, a sheet of the removable film 54 is attached to each side of the mesh structure 48. The removable film 54 adheres to the adhesive. The next step depends on the intended purpose for the particular piece of mesh structure 48.

If the particular piece is intended to be used as a rigid sheet 12, 28, as discussed above, then the mesh structure 48 is compressed between two hard flat surfaces such as steel plates. This creates the first and second flat surfaces 62, 64 on the longitudinally extending members 50, as well as aiding the texture on the removable film 54 to transfer to the adhesive coating to create the plurality of indentations 66. Furthermore, compressing the mesh structure 48 provides for flattened laterally extending members 52, as shown in FIG. 6, thereby decreasing the overall thickness of the mesh structure 48. Next, the adhesive coating is allowed to cure, thereby rigidifying the mesh structure 48. If the adhesive coating is an epoxy resin, curing is achieved by simply allowing the resin to dry in a well ventilated area. If the adhesive coating is a thermoset adhesive, the mesh structure 48 must be heated to an activation temperature. This is typically done in an oven. The mesh structure 48 is placed in the oven and heated until the adhesive coating hardens. Thereafter, the mesh structure 48 may be cut or sawn to obtain a rigid sheet 12, 28 of any desired size and/or shape. Furthermore, the vertical slots 16, 32, 34 may also be cut, sawn, or otherwise formed into the rigid sheet 12, 28 at desired locations.

If the intended use for the particular piece of mesh structure 48 is a bracket 14, 30, then alternative steps are taken. Prior to allowing the adhesive coating to cure, the mesh structure 48 is formed into a bracket 14, 30. Often times, forming the bracket 14, 30 may not immediately follow the adhesive application described above and, therefore, necessary precautions must be taken to ensure that the adhesive does not prematurely cure. If the adhesive is an epoxy resin, premature curing can be prevented by sealing the wetted mesh structure 48 in a vacuum sealed wrapping, such as a plastic wrap. If the adhesive is a thermoset adhesive, premature curing can be prevented by freezing the wetted mesh structure 48. The frozen mesh structure 48 can then be thawed immediately prior to forming.

Forming the mesh structure 48 or other fiber reinforced sheet into a bracket 14, 30 requires a die assembly. The mesh structure 48 is compressed between two dies to form the desired bracket 14, 30 prior to the adhesive coating curing. In addition to forming the desired bracket 14, 30, this also creates the first and second flat surfaces 62, 64 on the longitudinally extending members 50, as well as aiding the texture of the removable film 54 to transfer to the adhesive coating to create the plurality of indentations 66. Furthermore, the compression tends to flatten the laterally extending members 52, thereby decreasing the overall thickness of the mesh structure 48 or other fiber reinforced sheet.

Figure 7:
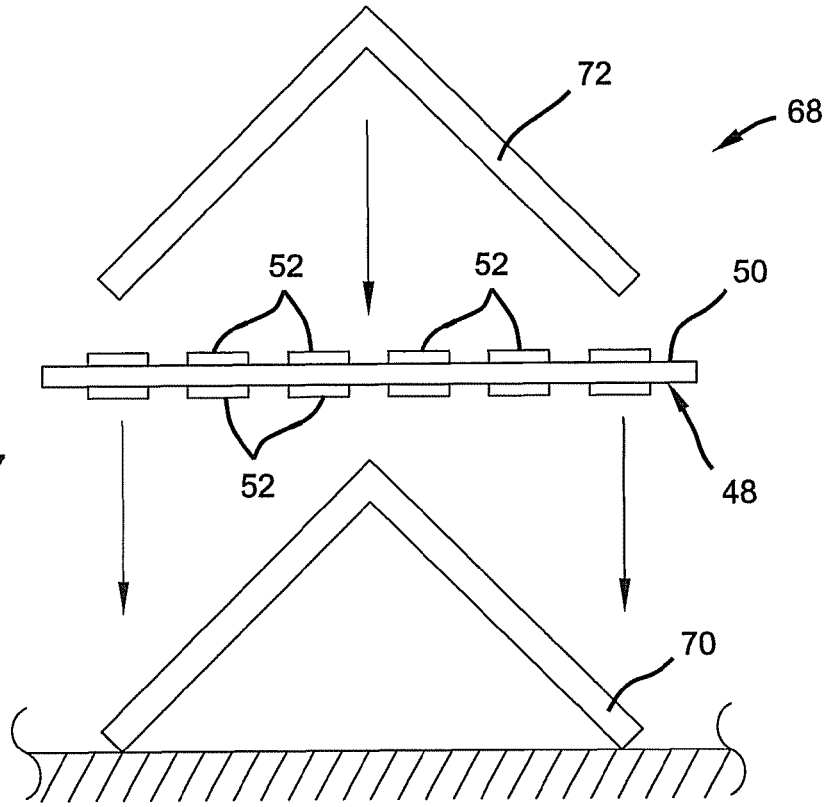
FIG. 7 is an end view of a first exemplary die assembly in accordance with the present invention.

FIG. 7 illustrates an exemplary die assembly 68 for forming an L-shaped bracket 14, as discussed above with reference to FIGS. 1 and 2. The mesh structure 48 is placed on a first die 70 and allowed to conform thereto. The first die 70 includes an elongated member having a generally inverted 90° L-shaped cross-section. It is important to note that the mesh structure 48 or other fiber reinforced sheet is placed on the first die 70 such that the longitudinally extending members 50 intersect the apex of the die 70. This ensures that the longitudinally extending members 50 are common to both the first 20 and second 22 legs of the bracket 14. This is important for the intended application because the longitudinally extending members 50 are designed to be strongest when loaded in tension. Therefore, the longitudinally extending members 50 of the first legs 20 of the brackets 14 will extend substantially perpendicular into the recesses 24 of the wall 18 to resist the wall 18 from bowing. In an exemplary embodiment, the longitudinally extending members 50 intersect the apex at approximately 90°. This is illustrated in FIG. 7. In an alternative embodiment, the longitudinally extending members 50 angularly intersect the apex at between 45° and 90°. After placing the mesh structure 48 or other fiber reinforced sheet on the first die 70, a second die 72 having substantially similar geometry to the first die 70 is placed over the mesh structure 48 or other fiber reinforced sheet, thereby compressing it into the L-shaped bracket 14.

Figure 8:
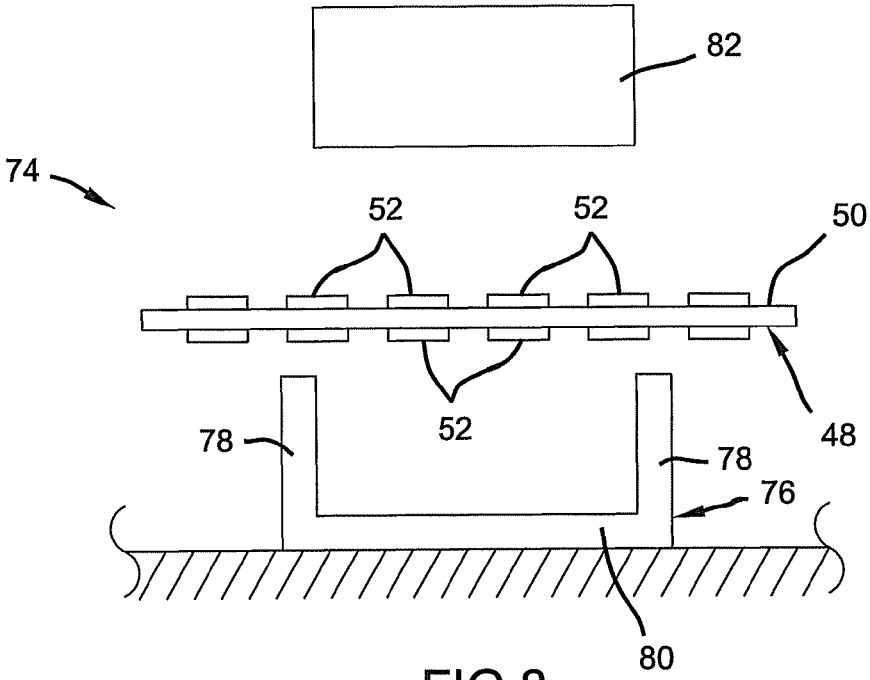
FIG. 8 is an end view of a second exemplary die assembly in accordance with the present invention.

FIG. 8 illustrates an exemplary die assembly 74 for forming a U-shaped bracket 30, as discussed above in accordance with FIGS. 3 and 4. A first die 76 generally includes an elongated member having a generally U-shaped cross-section defining a pair of sidewalls 78 and a base 80. The mesh structure 48 or other fiber reinforced sheet is placed therein and allowed to conform to its geometry. It should be appreciated that the mesh structure 48 or other fiber reinforced sheet must be placed in the U-shaped die 76 such as to form the longitudinally extending members 50 into a U-shape. As stated above, this is important because the longitudinally extending members 50 are strongest when loaded in tension. It is important to have as many longitudinally extending members 50 as possible common to the first leg 38, bridge portion 40, and second leg 42 of the brackets 30 to resist the wall 36 from bowing.

In an exemplary embodiment, the mesh structure 48 or other fiber reinforced sheet is placed in the U-shaped die 76 such that the longitudinally extending members 50 intersect the walls 78 at approximately 90°. This is illustrated in FIG. 8. In an alternative embodiment, the mesh structure 48 is placed in the U-shaped die 76 such that the longitudinally extending members 50 angularly intersect the walls 78 at between 45° and 90°. After placing the mesh structure 48 in the U-shaped die 76, a second die 82 is placed into the first die 76 to sandwich the mesh structure 48. The second die 82 includes an elongated member having a substantially rectangular cross-section. It should be appreciated that the rectangular die 82 has a slightly smaller horizontal dimension than the U-shaped die 76. In an exemplary embodiment, the horizontal dimension of the rectangular die 82 is approximately twice the thickness of the mesh structure 48 smaller than an inner horizontal dimension of the U-shaped die 76. This ensures that the rectangular die 82 will fit into the U-shaped die 76 to form a fiber reinforced bracket 30 having first 38 and second legs 42 substantially perpendicular to the bridge portion 40. It should be appreciated that the above-described dies are only exemplary in nature and that alternative means of creating similar fiber reinforced brackets are intended to be within the scope of the present invention. It should further be appreciated that while only L-shaped and U-shaped brackets have been disclosed herein, alternative geometries are intended to be within the scope of the present invention.

Finally, after the mesh structure 48 or other fiber reinforced sheet is appropriately compressed with the desired die assembly, the adhesive coating is allowed to cure and rigidify the bracket 14, 30. This is accomplished by either of the processes described above depending on the type of adhesive coating employed.

Figure 9:
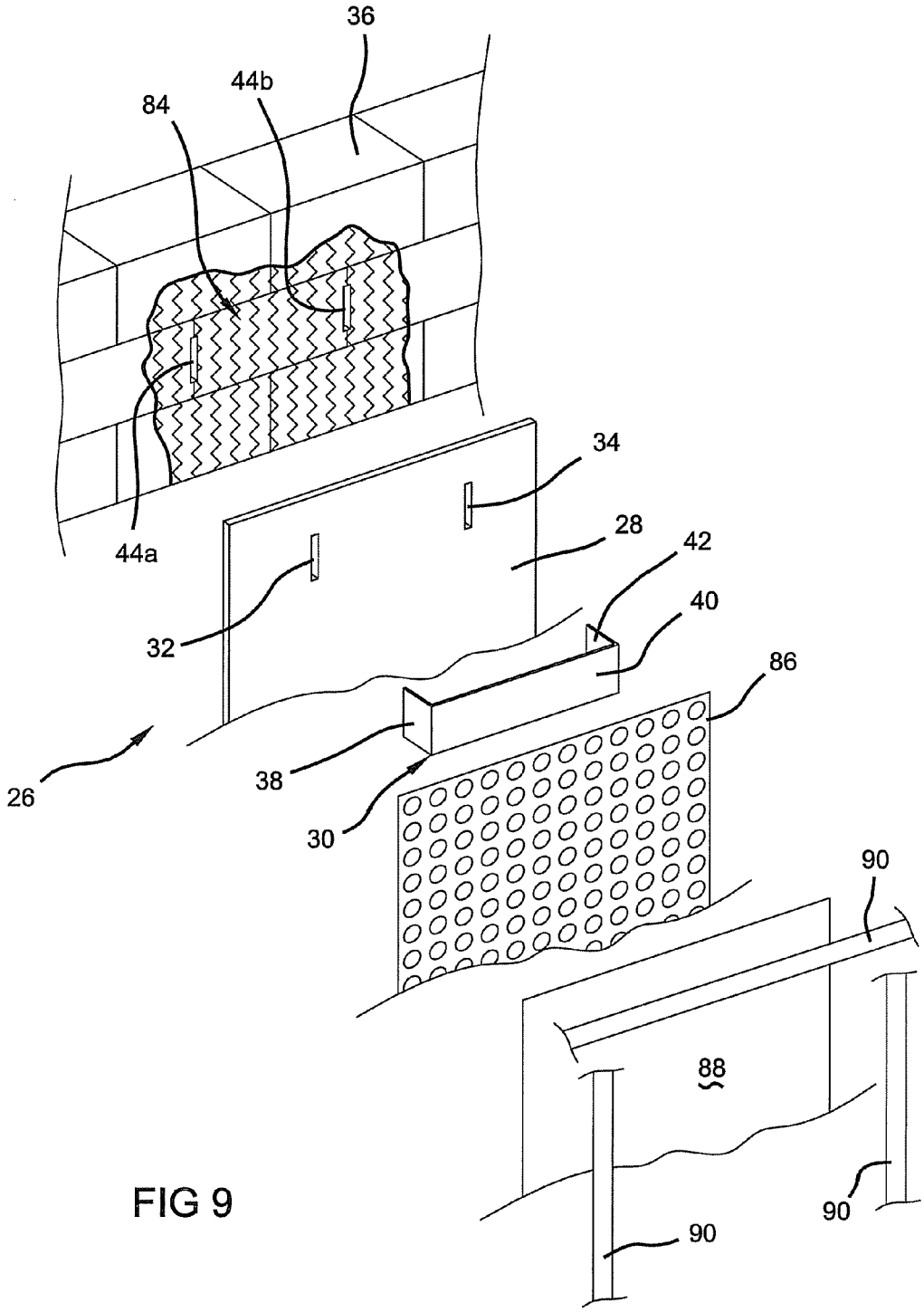
FIG. 9 is an exploded view illustrating various components utilized during an attachment process of a reinforcing assembly in accordance with the present invention.

With reference to FIG. 9, a process for attaching a reinforcing assembly 26 to a wall and the components necessary to do so are described. For the sake of brevity, the process is only described according to the second embodiment of the assembly 26. It should be appreciated, however, that a similar process can be employed for any of the embodiments of the present invention. As stated above, the assembly 26 generally includes a U-shaped bracket 30 and a rigid sheet 28 having first and second vertical slots 32, 34.

Initially, material is removed from the wall 36 to form a first elongated recess 44*a* and a second elongated recess 44*b*. The recesses 24 are positioned on the wall such that they can be aligned with the slots 32, 34 in the rigid sheet 28. In an exemplary embodiment, the slots 32, 34 in the rigid sheet are spaced apart the same distance as a pair of mortar joints in the masonry wall. This will provide for less work in the material removing process because mortar is typically softer than block or brick although it should be appreciate that the recesses 44*a*, 44*b* can also be formed in the blocks or bricks. An adhesive 84 is then applied to the wall 36 inside and around the first and second recesses 44. In an exemplary embodiment, the adhesive 84 includes an epoxy resin. Next, the rigid sheet 28 is positioned adjacent to the wall 36 such that the slots 32, 34 align with the recesses 44*a*, 44*b*, respectively. In the embodiment where the rigid sheet 28 is a mesh structure, it is important to note that the rigid sheet 28 should be positioned such that the longitudinally extending members 50 are vertical. This will ensure that when the rigid sheet 28 is secured to the wall 36, the longitudinally extending members 50 will be in tension to counteract the wall 36 from bowing outward. The rigid sheet 28 is then attached to the wall 36, via the adhesive 84. In the embodiment wherein the rigid sheet 28 includes a mesh structure 48, the adhesive 84 will squeeze through the perforations located between the longitudinally 50 and laterally 52 extending members (as shown in FIGS. 5 and 6). This will effectively encapsulate the members 50, 52 in the adhesive 84.

Next, the bracket 30 is positioned for insertion through the slots 32, 34 and into the recesses 44. The first and second legs 38, 42 of the bracket 30 are then inserted through the slots 32, 34 in the rigid sheet 28 and into the recesses 44. The bridge portion 40 is forced against the rigid sheet 28 and adhered thereto. If the rigid sheet 28 is a metal plate, additional adhesive 84 may be required in the region where the bridge portion 40 engages the rigid sheet 28. If the rigid sheet 28 is a mesh structure 48, no additional adhesive needs to be applied because excess adhesive 84 has already squeezed through the perforations between the longitudinally 50 and laterally 52 extending members. This excess adhesive 84 should suffice to adhere the bridge portion 40 to the rigid sheet 28. It should be appreciated, however, that additional adhesive 84 may be applied if necessary. The above process is repeated for as many brackets 30 as the specific application requires. Once the rigid sheet 28 and the bracket 30 are positioned on the wall 36, an additional step can be taken to ensure that no air pockets exist in the adhesive 84 behind the rigid sheet 28. It should be understood the sheet 28 can also be formed as a non-rigid member, although they are described herein as being generally rigid.

An evacuation material 86, such as commercially available bubble wrap or plastic sheeting, is positioned in front of the rigid sheet 28. An impermeable material 88, such as plastic, is positioned in front of the evacuation material 86 and fastened by its perimeter to the wall with strips of tape 90. The dimensions of the impermeable material 88 are slightly greater than the dimensions of both the rigid sheet 28 and the evacuation material 86 such that the strips of tape 90 can completely seal it to the wall 36. With the impermeable material 88 mounted to the wall 36 over the rigid sheet 28 and the evacuation material 86, air may be evacuated with a vacuum (not shown). The vacuum is coupled to a vacuum line fitted between the impermeable material 88 and the wall 36. Employing the vacuum in combination with the evacuation material 86 provides for uniform application of force across the entirety of the rigid sheet 28. If the rigid sheet 28 includes a mesh structure 48, as described above, the vacuum further squeezes the adhesive 84 through the perforations between the longitudinally 50 and laterally 52 extending members further encapsulating the mesh structure 48 therein. Under this method, the normal curing time for common epoxies is between 3-4 hours. Once cured, the impermeable material 88 and evacuation material 86 is removed from the wall 36. The rigid sheet 28 remains attached to the wall 36 via the adhesive 84 and the bracket 30 to counteract the wall 36 from bowing. It should be understood that the vacuum pressure may be unnecessary since applying a plastic sheet to damp adhesive creates a naturally occurring vacuum affect that resists the removal of the plastic from the reinforced structure.

Figure 10:
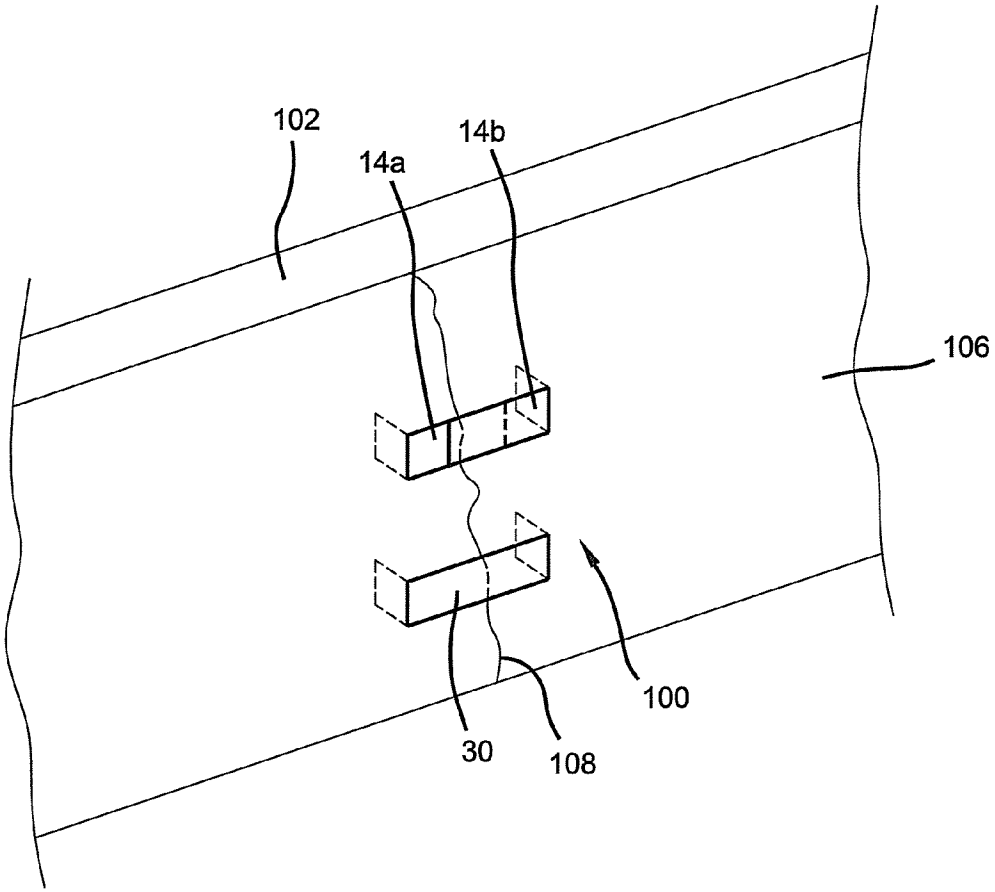
FIG. 10 is a perspective view of a third embodiment of a reinforcing assembly in accordance with the principles of the present invention.
Figure 11:
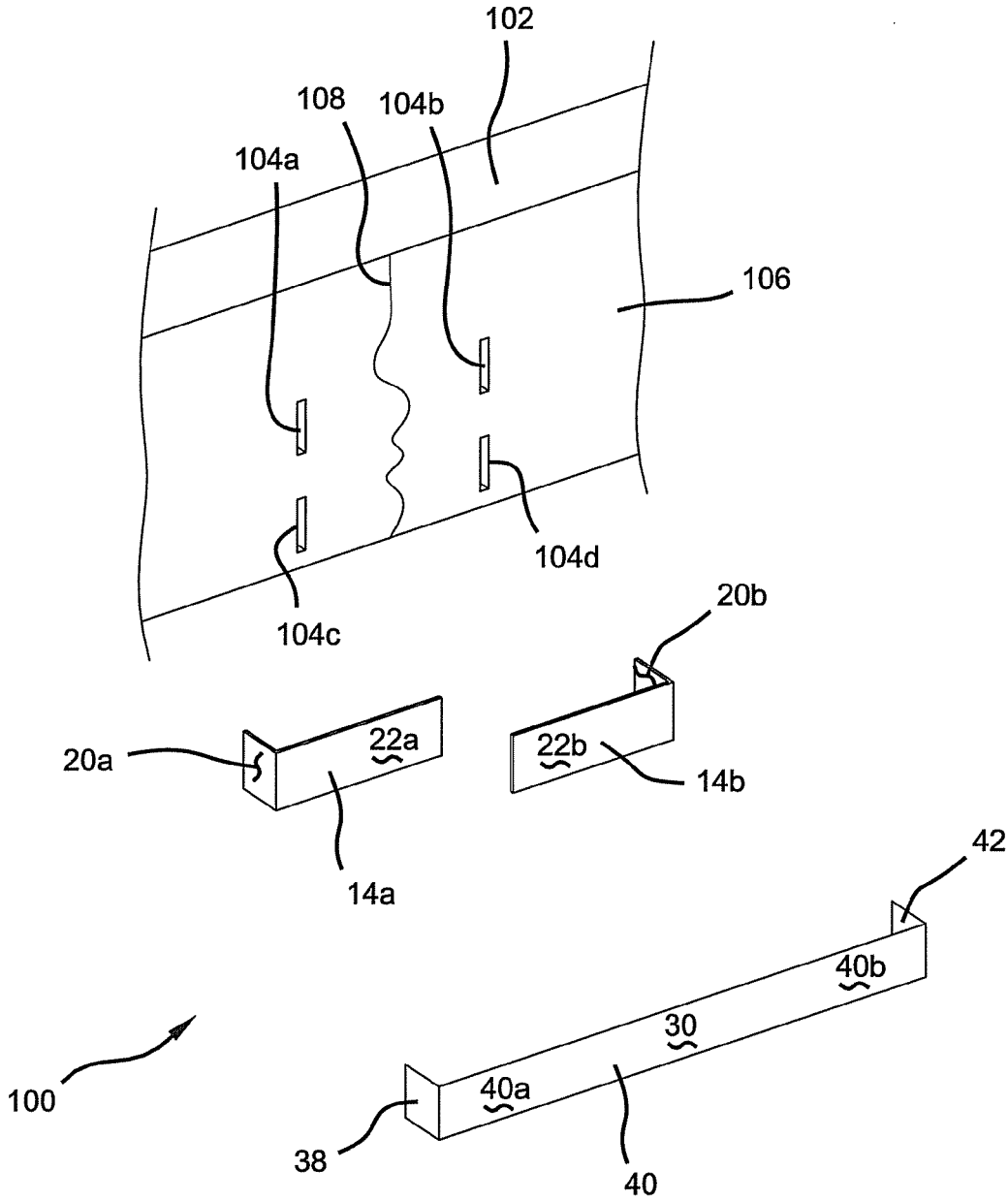
FIG. 11 is a partial exploded view of the reinforcing assembly of FIG. 11.

FIGS. 10 and 11 illustrate a third exemplary embodiment of a reinforcing assembly 100 in accordance with the present invention. The reinforcing assembly 100 includes at least one retaining member or bracket 14, 30. Bracket 14 is generally L-shaped and includes both first and second legs 20, 22 as discussed above. Bracket 30 is generally U-shaped and includes the first leg 38, the bridge portion 40, and the second leg 42, as discussed above. The brackets 14, 30 are adapted to be adhered to a structure 102, such as a solid concrete wall or support beam, to mechanically reinforce said structure 102. In one embodiment, the brackets 14, 30 are metal plates or fiber reinforced brackets. In another embodiment, the brackets 14, 30 are rigidified mesh-structures, as described above. It should also be understood that the brackets 14, 30 can also be formed as non-rigid fiber reinforced members although they are described in the preferred embodiments as being generally rigid.

In FIG. 10, the brackets 14, 30 are adhered to the structure 102. The brackets 14, 30 can engage the structure 102 in a variety of alternative configurations. In one exemplary configuration, the L-shaped brackets 14*a*, 14*b* are adhered to the structure 102 with an adhesive, such as an epoxy resin. The first leg 20 extends generally perpendicular from the second leg 22, although it should be appreciated that the first leg 20 can extend at any angle from the second leg 22. The first legs 20*a*, 20*b* are adapted to engage one of a plurality of recesses 104 (shown in FIG. 11) formed in the structure 102. Recesses 104 are formed when material is removed from the structure 102. The recesses 104*a*, 104*b* are preferably filled with an adhesive to securely anchor the first legs 20*a*, 20*b* in the recesses 104*a*, 104*b*. The second legs 22*a*, 22*b* are adapted to engage a surface 106 of the structure 102. The second legs 22*a*, 22*b* generally overlap a deficiency 108, such as a crack, flaw, or chip, in the structure 102. It should be appreciated that the second legs 22*a*, 22*b* can overlap one another. In such a configuration, the second leg 22*a* of the bracket 14*a* is adhered directly to the surface 106 of the structure 102 and the second leg 22*b* of the bracket 14*b* is adhered to the second leg 22*a* of the bracket 14*a*. It should be further appreciated that in another configuration that the first legs 20*a*, 20*b* of brackets 14*a*, 14*b* can engage the structure 102 in a single recess 104, as described above.

In an alternate configuration, the U-shaped bracket 30 is adhered to the structure 102 with an adhesive, such as an epoxy resin. The first leg 38 extends generally perpendicular from a first end 40*a* of the bridge portion 40, although it should be appreciated that the first leg 38 can extend at any angle form the first end 40*a*. The first leg 38 adhesively engages the recess 104*c* formed in the structure 102. The recess 104*c*, formed when material is removed from the structure 102, is preferably filed with an adhesive to securely anchor the first leg 38 within the recess 104*c*. The second leg 42 extends generally perpendicular from a second end 40*b* of the bridge portion 40, although it should be appreciated that the second leg 42 can extend at any angle form the second end 40*b*. The second leg 42 adhesively engages the recess 104*d* formed in the structure 102. The recess 104*d*, formed when material is removed from the structure 102, is preferably filed with an adhesive to securely anchor the second leg 42 within the recess 104*d*. The bridge portion 40 engages the surface 106 of the structure 102 located between the recesses 104*c*, 104*d* and is adhered thereto. The bridge portion 40 generally overlaps the deficiency 108 in the structure 102. In this manner, the bracket 30 mechanically reinforces the structure 102.

Figure 12:
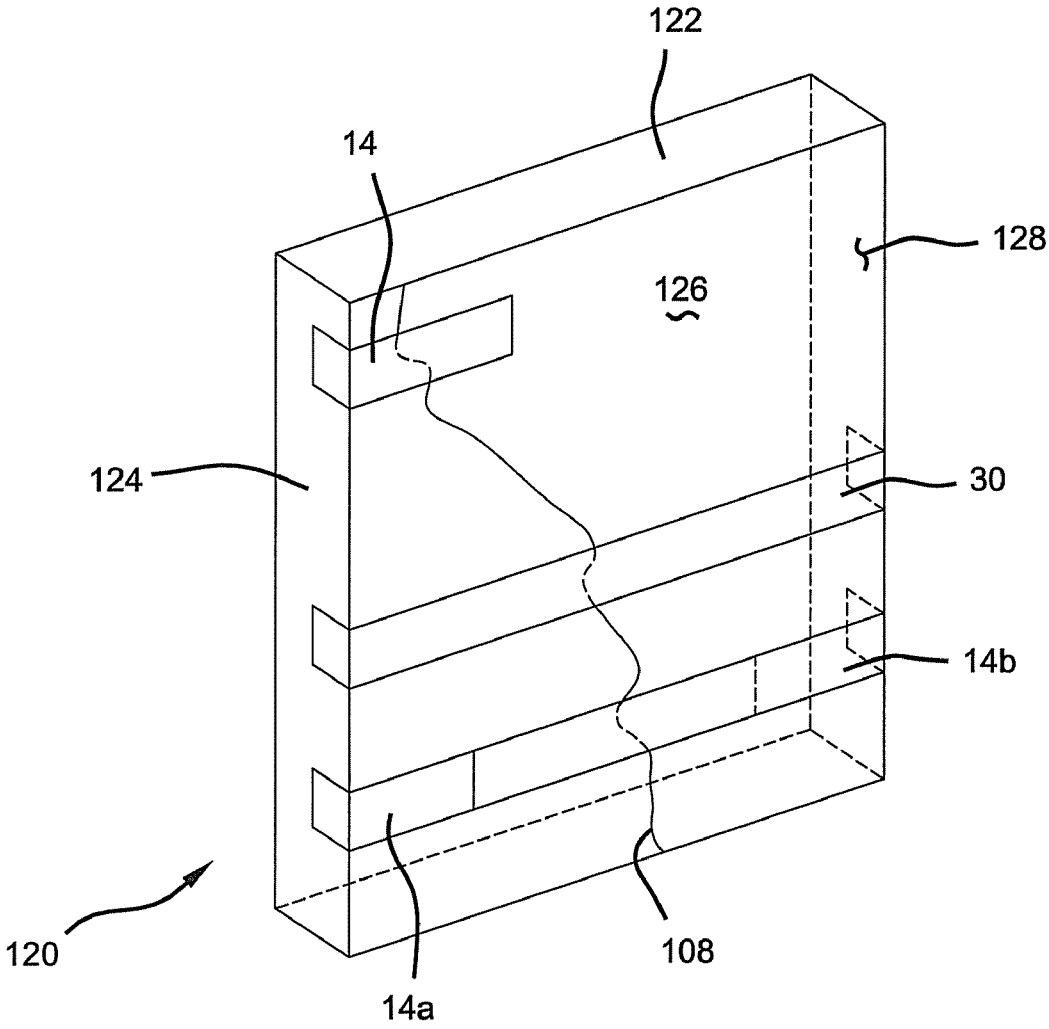
FIG. 12 is a perspective view of a fourth embodiment of a reinforcing assembly in accordance with the principles of the present invention.
Figure 13:
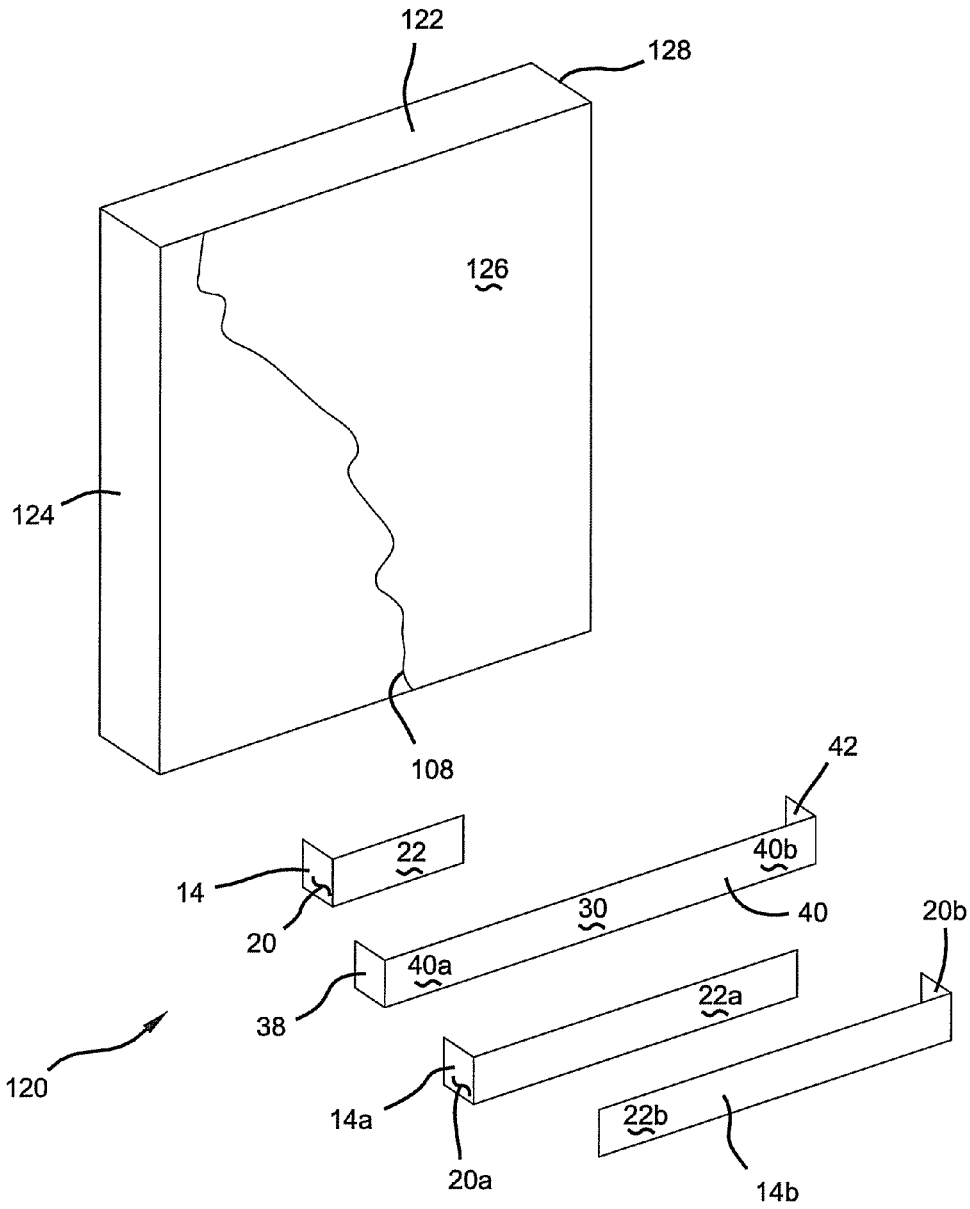
FIG. 13 is a partial exploded view of the reinforcing assembly of FIG. 12.

FIGS. 12 and 13 illustrate a fourth exemplary embodiment of a reinforcing assembly 120 in accordance with the present invention. The reinforcing assembly 120 includes at least one retaining member or bracket 14, 30. Bracket 14 is generally L-shaped and includes both the first and second legs 20, 22 as discussed above. Bracket 30 is generally U-shaped and includes the first leg 38, the bridge portion 40, and the second leg 42, as discussed above. The brackets 14, 30 are adapted to be adhered to a structure 122, such as a solid concrete wall or support beam, to mechanically reinforce said structure 122. In one embodiment, the brackets 14, 30 are metal plates. In another embodiment, the brackets 14, 30 are rigidified mesh-structures, as described above. It should also be understood that the brackets 14, 30 can also be formed as non-rigid fiber reinforced members although they are described in the preferred embodiments as being generally rigid.

In FIG. 12, the brackets 14, 30 are adhered to the structure 122. The brackets 14 can engage the structure 122 in a variety of alternative configurations. In one exemplary configuration, the L-shaped bracket 14 is adhered to the structure 122 with an adhesive, such as an epoxy resin. The first leg 20 extends generally perpendicular from the second leg 22, although it should be appreciated that the first leg 20 can extend at any angle from the second leg 22. The first leg 20 is adapted to engage one of a plurality of surfaces 124, 126, 128 of the structure 120. The adhesive is applied to the surface in an area adjacent to the area in which the bracket 14 is to be adhered. The adhesive securely anchors the first leg 20 to the surface 124. The second leg 22 is adapted to be adhered to the second surface 126 of the structure 122. The second leg 22 generally overlaps the deficiency 108 in the structure 122.

In an alternate configuration, two L-shaped brackets 14*a* and 14*b* may be utilized. In such a configuration the bracket 14*a* is adhered to the structure 122 in the same method as described above for the L-shaped bracket 14. Then, the adhesive is applied to the surface in an area adjacent to the area in which the bracket 14*b* is to be adhered. The first leg 20*b* of the bracket 14*b* is adhered to the third surface 128 of the structure 122 and the second leg 22 adhesively engages the second surface 126 of the structure 122. It should be appreciated the second legs 22*a*, 22*b* can overlap one another, as described above.

In another alternate configuration, the U-shaped bracket 30 is adhered to the structure 122 with an adhesive, such as an epoxy resin. The adhesive is applied to the surface in an area adjacent to the area in which the bracket 30 is to be adhered. The first leg 38 adhesively engages the first surface 124 of the structure 122. The second leg 42 adhesively engages the third surface 128 of the structure 122. The bridge portion 40 adhesively engages the second surface 126 of the structure 122. The bridge portion 40 generally overlaps the deficiency 108 in the structure 122. In this manner, the bracket 30 mechanically reinforces the structure 122.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A reinforcing system, comprising:

a concrete structure having a crack;

a plurality of first recesses formed in said concrete structure on opposite sides of said crack;

a rigidified reinforcing member having a first leg, a second leg, and a continuous bridge portion, said first leg extending from a first end of said bridge portion and adapted to penetratingly engage said concrete structure at a corresponding one of said plurality of first recesses, said second leg extending from a second end of said bridge portion and adapted to penetratingly engage said concrete structure at a corresponding another of said plurality of first recesses, said first and second legs are formed integral to said bridge portion and angularly extend from said bridge portion, said rigidified reinforcing member is coated with a first adhesive that is cured to rigidify said rigidified reinforcing member wherein said first leg, said second leg and said bridge portion are each rigidified in a generally planar configuration;

a second adhesive injected into said crack; and a third adhesive adhering said rigidified reinforcing member to said concrete structure with said first leg and said second leg adhered within said plurality of first recesses and said continuous bridge portion adhered to a face of said concrete structure and overlapping at least a portion of said crack.

2. The reinforcing system of claim 1 wherein said rigidified reinforcing member includes carbon fiber.

3. The reinforcing system of claim 2 further comprising a removable film on at least one side of said rigidified reinforcing member, wherein said removable film is textured to provide a plurality of indentations on at least a portion of said rigidified reinforcing member.

4. The reinforcing system of claim 1 wherein said second and third adhesive is an epoxy resin.

5. A reinforcing system, comprising:

a concrete structure having a crack;

a plurality of first recesses formed in said concrete structure, said first recesses having a depth less than the depth of said concrete structure and located on opposite sides of said crack;

a rigidified reinforcing member having a first leg, a second leg, and a continuous bridge portion, said first leg extending from a first end of said bridge portion and terminating within said concrete structure and adapted to adhere to a first surface of a corresponding one of said plurality of first recesses of said concrete structure, said second leg extending from a second end of said bridge portion and terminating within said concrete structure and adapted to adhere to a first surface of a corresponding another of said plurality of first recesses of said concrete structure, said bridge portion being adapted to adhere to a face of said concrete structure and overlapping at least a portion of said crack, said first and second legs are formed integral to said bridge portion and said first and second legs angularly extend from said bridge portion, said rigidified reinforcing member is coated with a first adhesive that is cured to rigidify said rigidified reinforcing member wherein said first leg, said second leg and said bridge portion are each rigidified in a generally planar configuration;

a second adhesive injected into said crack; and a third adhesive adhering said rigidified reinforcing member to said concrete structure, wherein the first and second legs of said rigidified reinforcing member are adhered in said first recesses.

6. The reinforcing system of claim 5 wherein said rigidified reinforcing member includes carbon fiber.

7. The reinforcing system of claim 6 further comprising a removable film on at least one side of said rigidified reinforcing member, wherein said removable film is textured to provide a plurality of indentations on at least a portion of said rigidified reinforcing member.

8. The reinforcing system of claim 5 wherein said second adhesive is an epoxy resin.

9. A reinforcing system comprising:

a structure including a first face having a crack and first and second recesses formed in said first face on opposite sides of said crack;

a rigidified reinforcing member including a first leg, a second leg, and a continuous bridge portion integrally formed and cooperating with each other to form a substantially U-shaped cross-section, said continuous bridge portion is disposed on said first face of said structure and traverses said crack, said continuous bridge portion having a first end and a second end on opposite side of said crack, said first leg extending from said first end of said continuous bridge portion and penetratingly engaging said first recess, said second leg extending from said second end of said continuous bridge portion and penetratingly engaging said second recess; and an adhesive adhering said first leg in said first recess, adhering said second leg in said second recess, and adhering said continuous bridge portion to said first face.

10. The reinforcing system of claim 9 wherein said rigidified reinforcing member includes carbon fiber.

11. The reinforcing system of claim 9 wherein said adhesive is an epoxy resin.

12. The reinforcing system of claim 9 wherein a second adhesive is injected into said crack.

13. The reinforcing system of claim 9 further comprising a removable film on at least one side of said rigidified reinforcing member, wherein said removable film is textured to provide a plurality of indentations on at least a portion of said rigidified reinforcing member.

* * * * *

UNITED STATES PATENT AND TRADEMARK OFFICE

CERTIFICATE OF CORRECTION

PATENT NO. : 7,823,354 B2
APPLICATION NO. : 11/272503
DATED : November 2, 2010
INVENTOR(S) : Donald E. Wheatley It is certified that error appears in the above-identified patent and that said Letters Patent is hereby corrected as shown below:

Column 7, line 25, after “first”, insert --legs--.

Column 7, line 57, “appreciate” should be --appreciated--.

Column 9, line 41, “form” should be --from--.

Column 9, line 44, “filed” should be --filled--.

Column 9, line 48, “form” should be --from--.

Column 9, line 51, “filed” should be --filled--.

Column 12, line 13, Claim 8, after “second”, insert --and third--.

Signed and Sealed this
Eighth Day of March, 2011

David J. Kappos

David J. Kappos
*Director of the United States Patent and Trademark Office*